US009045938B2

(12) United States Patent
Nugue et al.

(10) Patent No.: US 9,045,938 B2
(45) Date of Patent: Jun. 2, 2015

(54) LINKING ELEMENTS DESIGNED TO EQUIP PANELS, IN PARTICULAR GLASS PANELS, FOR FIXING AND PANELS EQUIPPED WITH SAME

(75) Inventors: Jean-Clement Nugue, Lamorlaye (FR); Celine Jedrzejewski, Varesnes (FR); Thomas Bertin-Mourot, Paris (FR); Jean-Christophe Lafon, Nogentel (FR)

(73) Assignee: SAINT-GOBAIN GLASS FRANCE, Courbevoie (FR)

( * ) Notice: Subject to any disclaimer, the term of this patent is extended or adjusted under 35 U.S.C. 154(b) by 846 days.

(21) Appl. No.: 11/719,833

(22) PCT Filed: Nov. 9, 2005

(86) PCT No.: PCT/FR2005/050938

§ 371 (c)(1),
(2), (4) Date: May 15, 2008

(87) PCT Pub. No.: WO2006/054011

PCT Pub. Date: May 26, 2006

(65) Prior Publication Data

US 2009/0145063 A1 Jun. 11, 2009

(30) Foreign Application Priority Data

Nov. 22, 2004 (FR) ..... 04 52717

(51) Int. Cl.

| | |
|---|---|
| ***E06B 3/02*** | (2006.01) |
| ***E06B 3/663*** | (2006.01) |
| *E06B 3/62* | (2006.01) |

(52) U.S. Cl.

CPC ..... *E06B 3/66342* (2013.01); *Y10T 403/1624* (2015.01); *E06B 3/02* (2013.01); *E06B 3/6202* (2013.01)

(58) Field of Classification Search

CPC ..... E06B 3/02; E06B 3/66342; E06B 3/6202; E06B 1/36; E04F 2201/00; Y10T 403/1624

USPC ..... 52/204.5, 582.1, 586.1, 586.2, 585.1, 52/582.2, 471

See application file for complete search history.

(56) References Cited

U.S. PATENT DOCUMENTS

| | | | | | |
|---|---|---|---|---|---|
| 2,392,551 | A | * | 1/1946 | Roe | 52/586.2 |
| 2,863,185 | A | * | 12/1958 | Riedi | 403/297 |
| 2,898,647 | A | * | 8/1959 | Bush et al. | 52/204.595 |
| 3,314,204 | A | * | 4/1967 | Zopnek | 52/308 |
| 4,824,722 | A | * | 4/1989 | Jarrett | 428/430 |
| 4,979,345 | A | * | 12/1990 | Celsi | 52/481.1 |

(Continued)

FOREIGN PATENT DOCUMENTS

| | | |
|---|---|---|
| DE | 195 42 040 A1 | 6/1996 |
| DE | 201 12 394 | 1/2002 |

(Continued)

*Primary Examiner* — Brian Glessner
*Assistant Examiner* — Jessie Fonseca
(74) *Attorney, Agent, or Firm* — Oblon, McClelland, Maier & Neustadt, L.L.P.

(57) ABSTRACT

A system for assembly between a connecting element and at least one cavity positioned on a surface portion situated on an edge face of a substrate, particularly made of a fragile material of glass type. The connecting element is configured to be accommodated in the cavity that has curved and retaining walls, the cavity being made at the edge face of the substrate.

16 Claims, 3 Drawing Sheets

(56) References Cited

U.S. PATENT DOCUMENTS

Figure 1:
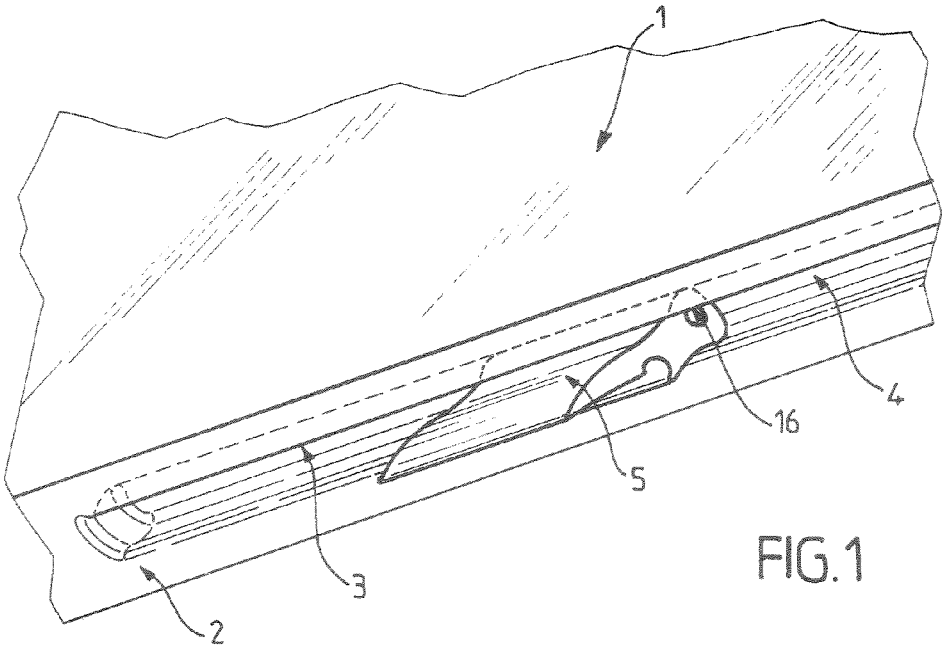

| | | | | |
|---|---|---|---|---|
| 5,641,558 | A * | 6/1997 | Noda et al. | 428/210 |
| 5,655,341 | A * | 8/1997 | Jaffiol et al. | 52/204.54 |
| 5,655,345 | A * | 8/1997 | Thompson | 52/396.1 |
| 5,758,459 | A * | 6/1998 | Koike et al. | 52/235 |
| 6,099,779 | A * | 8/2000 | Brandner et al. | 264/242 |
| 6,550,217 | B2 * | 4/2003 | Heung-Bin | 52/800.11 |
| 6,553,724 | B1 * | 4/2003 | Bigler | 52/36.1 |
| 7,152,383 | B1 * | 12/2006 | Wilkinson et al. | 52/581 |
| 7,225,543 | B2 * | 6/2007 | Kennedy et al. | 29/897.32 |
| 2002/0189190 | A1 * | 12/2002 | Charmat et al. | 52/586.2 |
| 2004/0016197 | A1 * | 1/2004 | Ruhdorfer | 52/578 |
| 2004/0060255 | A1 * | 4/2004 | Knauseder | 52/582.2 |

FOREIGN PATENT DOCUMENTS

| | | | |
|---|---|---|---|
| DE | 203 02 370 | | 5/2003 |
| DE | 20302370 | U1 * | 5/2003 |
| EP | 1 241 314 | | 9/2002 |
| FR | 2 836 951 | | 9/2003 |

* cited by examiner

LINKING ELEMENTS DESIGNED TO EQUIP PANELS, IN PARTICULAR GLASS PANELS, FOR FIXING AND PANELS EQUIPPED WITH SAME

The present invention relates to panels, particularly ones made of fragile material of the glass type, which are equipped in such a way as to be fixed to supports or joined together using connecting elements.

Such panels are intended in particular for producing walls or furniture made up of substrates, particularly transparent substrates, for example glass substrates.

To these ends, these panels have therefore to have holes at the fixing and/or connecting points. They may be strengthened, particularly using thermal or chemical toughening, in order to obtain the required mechanical (and, if appropriate thermal) strength. The holes therefore have to be made before the heat treatment is carried out.

Document DE19542040 discloses a glass panel which comprises, on its edge, a peripheral groove, this groove being intended to accommodate a joint, it being possible for the joint to be forcibly inserted into the groove or bonded or extruded into said groove.

The main disadvantage with this type of panel lies in particular in the fact that the attachment between the groove and its joint entails the use of an external agent or action.

In the case of bonding the adhesive chosen has to be deposited in advance on the faces of the joint and/or of the groove that are to be coated with adhesive, then the faces of the joint and/or of the groove are brought into contact, mechanical fastening of the whole being obtained only after a given setting time. This bonding technique is dependent or the time taken for the adhesive to set, and on the integrity of the adhesive over time, it being possible for the mechanical attachment between the joint and its groove to deteriorate over time as a result in particular of ageing of the adhesive (UV ageing for example) or as a result of inappropriate mechanical or chemical influences on the joint, of the detergent or solvent etc. type.

When the joint is "force-fitted" into the groove without any particular retaining appendages, the insertion is governed by the mechanical properties of the material of which the joint is made and, in particular the elastic deformation properties. As long as the joint is not mechanically stressed, it will remain retained in its groove, but, if, as a result of the material ageing, mechanical stresses that are inappropriate in terms of direction and/or in terms of intensity are applied, a gap may open up and lead to the joint escaping from its groove. In addition, it must be noted that "force-fitting" a component of the joint or connecting piece type is not the best way to insert a component when this component is supposed to be transmitting load.

When the joint is extruded into the groove, the major disadvantage lies chiefly in the "in situ" nature of the assembly phase. This "in situ" nature cannot readily be achieved when the substrates that are to be assembled come in kit form, something which is often the case with furniture or components of industrial equipment.

The present invention proposes a system for assembly between a connecting element and a cavity preferably positioned on a surface portion situated on the edge face or the edge of a substrate which does not have the disadvantages of the earlier techniques.

To this end, the system for assembly between a connecting element and at least one cavity positioned on a surface portion situated on the edge face of a substrate, made of a fragile material of the glass type characterized in that the connecting element is designed to be accommodated in the cavity that has curved and retaining walls, said cavity being made at the edge face of said substrate, the cavity being delimited by a side wall of concave profile, the concave side facing inward.

Within the meaning of the invention, the "edge face" is defined as being the long narrow face of a large-sized element.

In preferred embodiments of the invention, recourse may also possibly be had to one and/or other of the following arrangements:

- the cavity is blind;
- the cavity has a circular or oblong cross section;
- the connecting element is formed of at least one component made in a deformable material;
- the connecting element forms a joint;
- the connecting element is essentially made up of a sealing lip which, on the opposite side to its actual sealing ridge proper, has a blunt end, from which a shoulder emerges on one side, said shoulder bearing projecting parts of convex profile that complement the profile of the concave faces produced in said cavity;
- a second shoulder is added to the connecting element at the level of the edge face of the substrate, both for esthetic and for cleaning purposes,
- the connecting element consists of an insert intended to be introduced into the corresponding cavity of the substrate, said insert comprising projecting parts capable of flexing elastically or even plastically inward so as to allow said element to be fitted into the corresponding cavity of said substrate;
- the connecting element comprises at least two inserts each comprising projecting parts of convex profile that complements the profile of the concave faces made in said cavity, said inserts being joined together by a flexible central part forming an articulation between the two inserts;
- the collaboration between the connecting element and the cavity is tailored to ensure that said connecting element is self-immobilizing within the cavity;
- the connecting element comprises, at the center of the projecting parts of convex profile, an orifice tailored to the insertion of a locking rod;
- the connecting element comprises a hollowed part situated at a region of connection connecting the lip or the flexible part and the shoulder;
- a wetting agent is interposed at the interface between the side wall of the cavity and the connecting element in order to improve the surface appearance.

The present invention also relates to a panel, particularly made of fragile material of the mineral or organic glass type, comprising, on at least one of its faces, particularly at its edge face, a cavity intended to accommodate at least one connecting element as defined hereinabove. It also relates to such a panel equipped with its connecting element or elements. It also relates to a panel which has been equipped with its connecting element or elements and in which the or each connecting element has received a member allowing connection with a support, it being possible for this support to be another panel.

As indicated hereinabove, the fragile material of which these panels are made is generally toughened glass or, more generally, a glass substrate which can undergo a heat treatment or chemical treatment, particularly a toughening, a semi-toughening, an annealing, or a bending treatment, of alternatively a glass that is mechanically strengthened, once the cavities have been produced.

The present invention also relates to an assembled assembly or an assembly to be assembled comprising at least one panel of fragile material of the glass type as defined hereinabove.

In particular, such an assembly constitutes an element of furniture, a partition wall of a piece of furniture, a room, a shower cubicle, a shelf unit, a shelf for a refrigerator, for example, shop furniture, display cabinets, doors or shop windows.

Such an assembly may constitute double glazing or even triple glazing, each of the substrates forming this assembly being assembled and joined together by connecting elements.

Finally, the present invention relates to a method of manufacturing a panel designed to be mounted on a support so as to constitute an assembled assembly, characterized in that at least one cavity is machined in at least one surface portion of the panel, particularly one made of fragile material of the glass type which has not undergone any heat treatment, at the site of the connecting elements, each aforementioned cavity being shaped in such a way as to allow a connecting element as previously defined to be introduced and retained therein, in that said panel then undergoes a heat treatment or chemical treatment, and in that a connecting element of complementary shape as previously defined is then placed in each of the cavities.

Figure 2:
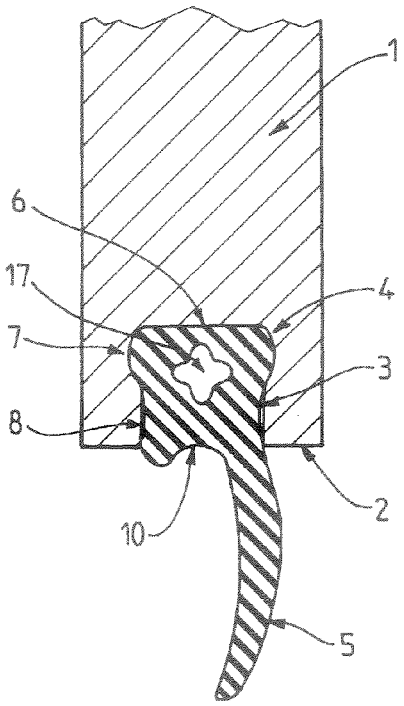
Figure 3:
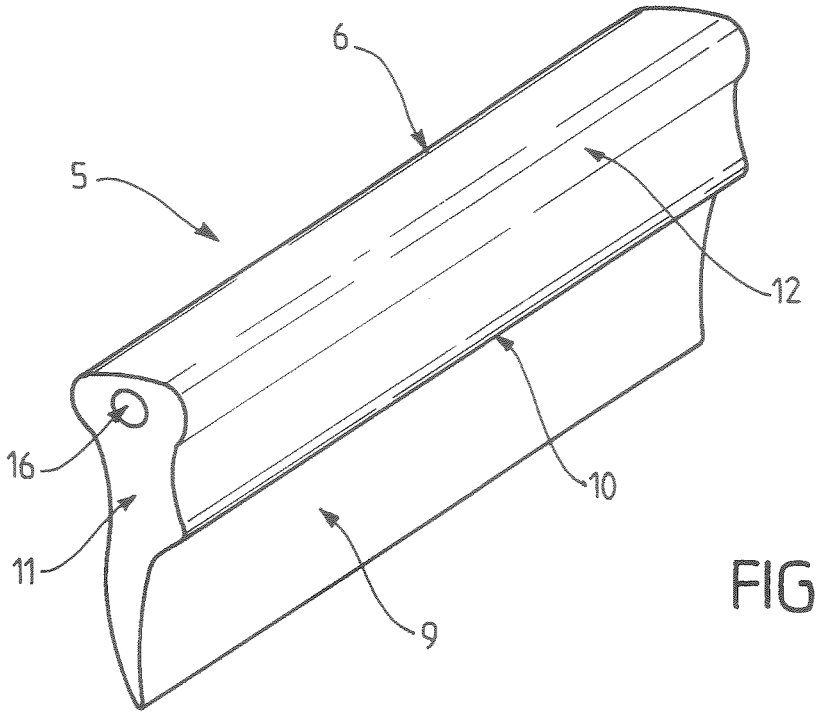
Figure 4:
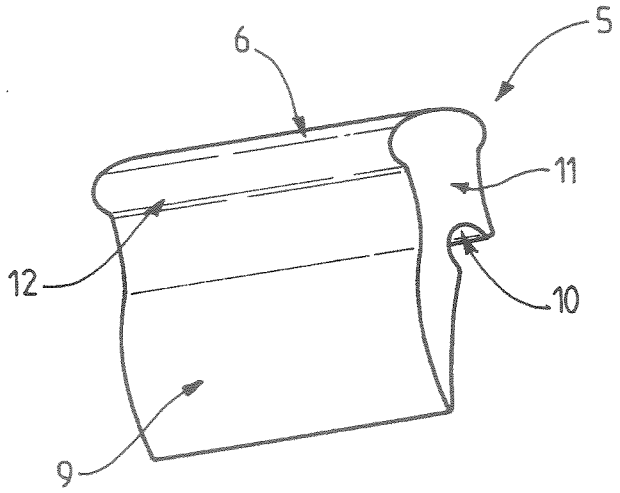
Figure 5:
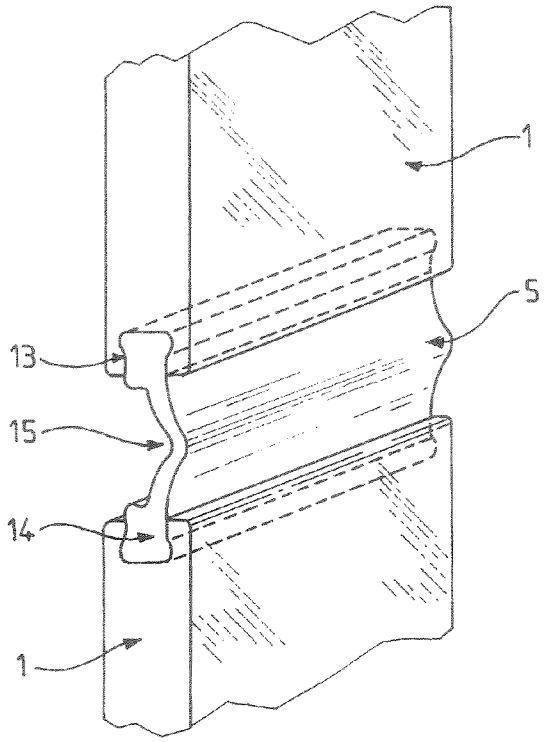
Figure 6:
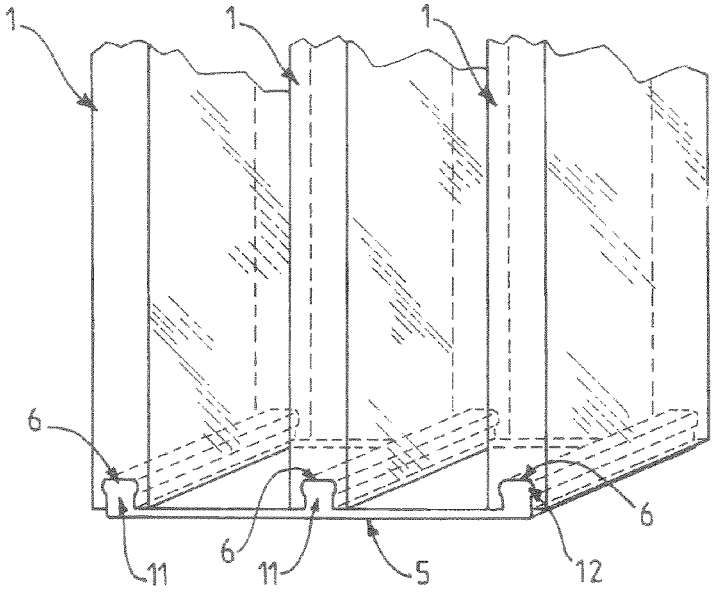

In order to better illustrate the subject of the present invention various particular embodiments thereof will be described hereinafter by way of nonlimiting indication with reference to the attached drawings in which:

FIG. 1 is a perspective view of a substrate equipped at one of its edge faces with a connecting element consisting of a joint, FIG. 2 is a view in section of the joint depicted in FIG. 1, FIG. 3 is a perspective view of a variant embodiment of the joint, FIG. 4 is a perspective view of another variant embodiment of the joint, FIG. 5 is a perspective view of a variant embodiment of the connecting element, FIG. 6 is a perspective view of another variant embodiment of the connecting element designed for the assembly of multiple glazing.

FIG. 1 depicts a monolithic pane 1 provided over at least a portion of its surface and at its edge face 2, with at least one groove 3, which was made before the pane was toughened, parallel to the main faces of this pane and along the edge face.

In the conventional way, the edge corners at the transitions between the face forming the edge face and the two main faces of the pane are blunted in the usual way, for example by beveling.

As can be seen in FIG. 1, there are still remaining surfaces at the edge face on either side of the groove 3.

The cross section of the groove is rectangular in a first part near these remaining surfaces, then is of rounded shape in a second part forming the closed end of the groove. The closed end must, however, be well rounded in order to prevent any stress peak in the corners and minimize the slotting effect of the groove.

A series of milling cutters with suitable profiles and tooth configurations (a roughing cutter, a semi-finishing cutter and a finishing cutter) are used to produce within this groove a blind cavity 4. Of course, the cavities may have varying cross sections, particularly circular or oblong cross sections according to the intended application.

According to a variant embodiment of the groove, the latter is obtained using abrasive disks or abrasive cutting wheels. These abrasive tools are of course rotationally driven and positioned on a pivoting or inclinable head. Thus, by inclining the tool with respect to the normal to the edge or to the edge face of the glass substrate and by combining this movement with a forward feed, a groove with the desired profile is obtained after a number of machining passes.

The cavity 4 is delimited by a flat closed end perpendicular to the main faces of the glass panel and by a side wall connected to the closed end by a curved and retaining, particularly concave, region, the concave face facing toward the inside of the cavity and exhibiting axial symmetry, followed by a short oblong region, to open onto the remaining surfaces in the form of a frustoconical region widening outwards. This region thus, with the neighboring parts of the regions, forms a catching or retaining bulge the purpose of which is discussed later on.

According to a preferred embodiment, the concave region in fact comprises a first part with a first radius of curvature $R_1$ and constituting the start of the concave feature in the vicinity of the closed end, and a second part meeting the oblong region and having a second radius of curvature $R_2$ shorter than the first.

According to a second preferred embodiment, the concave region has the same radius of curvature between the closed end wall and the oblong region on the edge face of the panel.

As appropriate the groove 3 may also have a cross section involving an undercut, if corresponding manufacturing capabilities exist and if the total thickness of the panel is sufficient.

The cavity 4 is intended to accommodate a connecting element 5 molded in a plastic such as PVDF (polyvinylidene fluoride) for example, or cast in metal (aluminum for example).

As can best be seen in FIG. 2, the connecting element 5 comprises a peripheral wall 7 connected to a more or less flat blunt end 6. This connecting element 5 is either one-piece or made up of several elements. It can be deformed elastically or even plastically to allow it to be inserted into the cavity 4.

The external face of the wall 7 meets the blunt end 6 in the form of a curved region the shape of which allows it to hug that of the concave region of the cavity 4. The curved region is extended by a low wall 8, which is intended to bear against the oblong region delimiting the cavity 4 to terminate, after a step inward, in another oblong region.

Depending on the application and particularly in the one to which this example relates, it may be important to render the face facing the user, the hole and its insert invisible. To this end, a wetting agent, such as silicone, or a lubricant possessing this property for example, is interposed at the interface between the internal side wall of the cavity 4 and the external wall 7 of the connecting element 5 in order to improve the surface appearance.

According to a preferred embodiment (depicted in FIGS. 3 and 4 for example), the connecting element 5 constitutes a sealing joint made of an elastic material which is essentially made up of a sealing lip 9 with a cross section shaped in accordance with the requirements. The triangular depiction of the sealing lip chosen solely with a view to providing a schematic depiction does not therefore restrict the use of other shapes of cross section, for example also of sealing lips in the form of ribs or flexible pipes, such as are known in the prior art. The free vertex of the triangle forms the actual sealing ridge proper which in the mounted state presses in a sealed manner against some other body (for example the top edge of a shower cubicle).

The sealing lip 9 has, at the opposite end to its sealing ridge proper a blunt end 10 which may be flat (cf. FIG. 3) or provided with a dished region (cf. FIG. 4) from which a shoulder 11 emerges from one side and preferably also as a single piece. This shoulder 11 is intended to be inserted in the groove 3 of the pane 1.

In order to anchor it more securely in the groove 3, the shoulder 11 bears, on both sides, protecting parts 12 of convex profile complementing the profile of the concave faces made in the cavity 4.

These convex parts 12 are made of one piece with the shoulder 11 and are elastically deformable.

Furthermore, it might also be conceivable for the shoulder 11 with the convex parts 12, on the one hand, and the sealing lip 9, on the other hand, to be prefabricated separately and assembled later (clipping, bonding, fusion). This would possibly have the advantage that the shoulder and the sealing lip could be made of different materials (and in particular also have different hardnesses).

Sealing strips of this kind are, however, usually economically manufactured in a single piece in the form of products by the meter, by extrusion molding in all conceivable cross-sectional shapes as required. As a general rule, it is, however, also possible for strips made of different materials to be manufactured more or less as a single piece by co-extrusion.

To fit the connecting element 5 (in this specific instance, a seal) into the groove 3 of the panel 1 (the glazing or the like), it is necessary simply to cut the piece to suit the respective length of the groove and to "forcibly" drive it into the groove in the correct position. The convex parts 12 are then elastically deformed.

The seal thus plugs the groove with respect to the outside. It goes without saying that the length of the shoulder needs to be consistent with the depth of the groove, particularly that it should be a little shorter than the depth of the groove.

As a variant (not depicted in the figures), the connecting element 5 consists of an element in the form of an insert intended to be introduced into the corresponding cavity of the panel, said insert comprising radial notches made in its side wall in order thus to constitute petals capable of flexing elastically or even plastically inward so as to allow said element to be inserted into the corresponding cavity of the panel.

This insert may collaborate with a rod or any other kind of similar member possibly provided with a screwthread supposed to allow it to collaborate with another insert intended to collaborate with another cavity of another panel in order thus to form elements (furniture or the like).

As a variant, the connecting element 5 may consist of any kinematic linkage allowing a panel made of fragile material to be connected to a support. Thus, this kinematic linkage may comprise a ball joint, possibly extended by a rod, an articulation, a box, etc.

According to yet another variant depicted in FIG. 5, the connecting element 5 comprises at least two inserts 13, 14 each comprising projecting parts of convex profile 12 complementing the profile of the concave faces made in said cavity 4, said inserts being joined together by a flexible central part 15 forming an articulation between the two inserts 13, 14.

Furthermore, as can be seen in FIGS. 1, 2, 3, the connecting element 5 comprises, at the projecting convex-profile part 12, an orifice 16 designed for the passage of a locking rod 17 (depicted in FIG. 2). This locking rod 17 is removable and allows the connecting element to be removed easily, thereby making it easier to replace the connecting element or to clean it. Furthermore, a dished region may be provided at a connecting region where the lip or flexible part meets the shoulder (this is visible in FIGS. 1 and 4).

Glass panels which have undergone a chemical or heat treatment (for example a toughening treatment) are prepared as follows: firstly, the panels are cut from non-toughened glass; the cavities are machined at the intended locations (generally at least at a surface portion of the edge face of said panel), the panels then undergo the heat treatment or chemical treatment (here in this examples a toughening treatment). The concave region of the side walls delimiting the cavities spreads the stresses that arise within the glass during the toughening treatment. In particular, the profile of this concave region in terms of the choice of the radius of curvature makes it possible to ensure that toughening can be performed without causing the glass to break in this region, thus avoiding having to scrap panels.

Next, the connecting elements are introduced into the cavities. As already stated, this insertion of the connecting elements is very easy because of the elasticity or even the plasticity thereof. The panels can be delivered ready-equipped with their connecting elements.

In general, the connecting element 5 allows a framework to be assembled with a panel.

According to yet another embodiment of the invention, the connecting element (depicted in FIG. 6) serves to assemble multiple glazing. In this example, it is triple glazing (of course, a variant for double glazing can be readily deduced from the foregoing), the connecting element is tripled, a central element and two lateral elements collaborating respectively with the same number of cavities made in the edge faces of the glazings. The choice of material from which to make the connecting element is chosen to afford the assembly mechanical strength once assembled and, if necessary, to afford sealing if the multiple glazing is assembled incorporating gas between the glazing units. If need be, the connecting elements are sealed against atmospheric pressure in as much as a vacuum may be created between the glazings.

The invention as described hereinabove offers numerous advantages:

- the connection is relatively insensitive to manufacturing tolerances,
- the connection can be dissembled and is able to bear relatively high mechanical loads.

Of course the embodiment described hereinabove is entirely nonlimiting and may give rise to any desirable modifications without thereby departing from the scope of the invention.

The invention claimed is:

1. A system for assembly, comprising:

a connecting element; and a glass substrate including at least one cavity disposed in a surface portion of an outermost peripheral edge face of the substrate, the cavity being oriented in a width direction perpendicular to opposing main faces of the glass substrate, and the cavity extending longitudinally along a length of the edge face of the substrate, wherein the connecting element extends longitudinally and is configured to be accommodated in the longitudinal extension of the cavity, wherein the cavity includes a first side wall, a second side wall, and a planar closed end adjoining the first and second side walls, such that first corners where the first and second side walls adjoin the closed end, respectively, are rounded, wherein each of the first and second side walls includes a concave wall portion and an oblong wall portion, the concave wall portions facing inward, where second corners located between the concave wall portion and the oblong wall portion of each of the first and second side walls are rounded, wherein, in a position where the connecting element is inserted into the cavity, a surface portion of the connecting element conforms to a profile shape of the planar closed end, the concave wall portions, and the oblong wall portions of the cavity so as to be self-immobilizing within the cavity, and wherein the connecting element includes projecting parts that are elastically flexible inwards such that the connecting element fits into a longitudinal extension of the cavity by force in a direction that is transverse to a direction of the longitudinal extension of the cavity.

2. The system as claimed in claim 1, wherein the cavity is blind.

3. The system as claimed in claim 1, wherein at least a portion of a cross section of the cavity is curved or oblong.

4. The system as claimed in claim 1, wherein the connecting element is a joint.

5. The system as claimed in claim 4, wherein the joint includes a sealing lip having a sealing ridge, and a blunt end disposed opposite the sealing ridge, the blunt end including a shoulder disposed on one side of the blunt end, the shoulder including projecting convex parts that correspond to the concave portions of the side walls of the cavity.

6. The system as claimed in claim 5, wherein the connecting element includes a hollowed part disposed at a region of connection connecting the sealing lip and the shoulder.

7. The system as claimed in claim 1, wherein the connecting element includes at least two inserts each including projecting parts of convex profile that complement a profile of concave faces in the cavity, the inserts being joined together by a flexible central part forming an articulation between the two inserts.

8. The system as claimed in claim 7, wherein the connecting element includes, between the projecting parts of convex profile of one of the at least two inserts, an orifice configured for insertion of a locking rod.

9. The system as claimed in claim 1, wherein a wetting agent is interposed at an interface between the first and second side walls of the cavity and the connecting element to improve surface appearance.

10. The system as claimed in claim 1, wherein the glass substrate comprises mineral glass or organic glass.

11. The system as claimed in claim 1, wherein the glass substrate is a planar glass sheet.

12. A panel made of glass, comprising:

at least one cavity disposed in a surface portion of the panel, the cavity being configured to accommodate at least one connecting element, the cavity being oriented in a width direction perpendicular to opposing main faces of the panel, and the cavity extending longitudinally along a length of an outermost peripheral edge face of the panel, wherein the cavity includes a first side wall, a second side wall, and a planar closed end adjoining the first and second side walls, such that first corners where the first and second side walls adjoin the closed end, respectively, are rounded, and wherein each of the first and second side walls includes a concave wall portion and an oblong wall portion, the concave wall portions facing inward, where second corners located between the concave wall portion and the oblong wall portion of each of the first and second side walls are rounded.

13. The panel as claimed in claim 12, further comprising the at least one connecting element, wherein the connecting element extends longitudinally and is configured to be accommodated in the longitudinal extension of the cavity, wherein, in a position where the connecting element is inserted into the cavity, a surface portion of the connecting element conforms to a profile shape of the planar closed end, the concave wall portion, and the oblong wall portion of the cavity so as to be self-immobilizing within the cavity, and wherein the connecting element includes projecting parts that are elastically flexible inwards such that the connecting element fits into a longitudinal extension of the cavity by force in a direction that is transverse to a direction of the longitudinal extension of the cavity.

14. The panel as claimed in claim 12, wherein the glass is toughened, semi-toughened, annealed, or mechanically strengthened glass.

15. An assembly, comprising:

at least one panel made of glass; and at least one connecting element, wherein the at least one panel comprises at least one cavity disposed in a surface portion of the panel, the cavity being configured to accommodate the at least one connecting element, the cavity being oriented in a width direction perpendicular to opposing main faces of the panel, and the cavity extending longitudinally along a length of an outermost peripheral edge face of the at least one panel, wherein the cavity includes a first side wall, a second side wall, and a planar closed end adjoining the first and second side walls, such that first corners where the first and second side walls adjoin the closed end, respectively, are rounded, and wherein each of the first and second side walls includes a concave wall portion and an oblong wall portion, the concave wall portions facing inward, where second corners located between the concave wall portion and the oblong wall portion of each of the first and second side walls are rounded, wherein the connecting element extends longitudinally and is configured to be accommodated in the longitudinal extension of the cavity, wherein, in a position where the connecting element is inserted into the cavity, a surface portion of the connecting element conforms to a profile shape of the planar closed end, the concave wall portions, and the oblong wall portions of the cavity so as to be self-immobilizing within the cavity, and wherein the connecting element includes projecting parts that are elastically flexible inwards such that the connecting element fits into a longitudinal extension of the cavity by force in a direction that is transverse to a direction of the longitudinal extension of the cavity.

16. The assembly as claimed in claim 15, wherein the at least one panel comprise a plurality of panels.

* * * * *